US007334863B2

(12) United States Patent
Nishi et al.

(10) Patent No.: US 7,334,863 B2
(45) Date of Patent: Feb. 26, 2008

(54) NOZZLE CAP, HEAD CAP UNIT, AND LIQUID EJECTION HEAD

(75) Inventors: Shota Nishi, Kanagawa (JP); Masato Nakamura, Kanagawa (JP); Takumi Namekawa, Kanagawa (JP); Shigeyoshi Hirashima, Kanagawa (JP)

(73) Assignee: Sony Corporation, Tokyo (JP)

( * ) Notice: Subject to any disclaimer, the term of this patent is extended or adjusted under 35 U.S.C. 154(b) by 278 days.

(21) Appl. No.: 11/024,271

(22) Filed: Dec. 28, 2004

(65) Prior Publication Data

US 2005/0151778 A1 Jul. 14, 2005

(30) Foreign Application Priority Data

Jan. 8, 2004 (JP) ..... 2004-003044

(51) Int. Cl.
*B41J 2/165* (2006.01)

(52) U.S. Cl. ..... 347/22; 347/29

(58) Field of Classification Search ..... 347/29, 347/20, 22, 30, 33, 34
See application file for complete search history.

(56) References Cited

U.S. PATENT DOCUMENTS

2002/0175970 A1* 11/2002 Arai et al. ..... 347/33

FOREIGN PATENT DOCUMENTS

| | | | | |
|---|---|---|---|---|
| JP | 08-187870 | | 7/1996 | |
| JP | 08-258276 | | 10/1996 | |
| JP | 2003-170606 | | 6/2003 | |
| WO | WO 03/055686 | * | 7/2003 | ..... 347/56 |

* cited by examiner

*Primary Examiner*—Juanita D. Stephens
(74) *Attorney, Agent, or Firm*—Robert J. Depke; Rockey, Depke & Lyons, LLC.

(57) ABSTRACT

A liquid ejection head including a reusable nozzle cap and head cap unit that prevents ink from leaking during transport and storage. When the liquid ejection head is in use, the nozzle cap can be readily detached from the liquid ejection head without damaging an ejection surface of a nozzle sheet from which ink is ejected. The liquid ejection head can also be used with a large nozzle sheet. The nozzle cap is incorporated in the liquid ejection head that ejects ink in an ink reservoir through nozzles in the nozzle sheet. Stoppers are disposed below the ejection surface of the nozzle sheet to cover the nozzles, thereby preventing ink from leaking. The stoppers are composed of a resilient material that does not adhere to the nozzle sheet and that inhibits ink from passing therethrough.

9 Claims, 6 Drawing Sheets

NOZZLE CAP, HEAD CAP UNIT, AND LIQUID EJECTION HEAD

The present application claims priority to Japanese Patent Application JP2004-003044, filed in the Japanese Patent Office Jan. 8, 2004; the entire contents of which is incorporated herein by reference.

BACKGROUND OF THE INVENTION

1. Field of the Invention

The present invention relates to liquid ejection heads used for, e.g., inkjet printers, and nozzle caps and head cap units in the liquid ejection heads, and more particularly, to a liquid ejection head including a reusable nozzle cap and head cap unit that prevents liquid from leaking through nozzles during transport and prevents a nozzle sheet including the nozzles from being damaged when the liquid ejection head is in use and to the nozzle cap and the head cap unit in the liquid ejection head.

2. Description of the Related Art

Liquid ejection heads or printer heads for inkjet printers that are integrated with ink cartridges are known (See Japanese Unexamined Patent Application Publication No. 2003-170606). With this type of printer head, a protective sheet is affixed to a nozzle sheet including nozzles to prevent ink from leaking through the nozzles during transport or storage. When the printer head is used, the protective sheet is removed to expose the nozzles, and the printer head is mounted in the inkjet printer.

Furthermore, printer heads having protective caps for preventing ink leakage are known (See Japanese Unexamined Patent Application Publication Nos. Hei 8-187870 and Hei 8-258276). This type of printer head is provided with a protective cap including a cap body, a sponge, and a protective seal. The sponge presses the protective seal against a nozzle sheet, thereby preventing ink leakage.

However, with the technique disclosed in Japanese Unexamined Patent Application Publication No. 2003-170606, when the protective sheet is removed from the nozzle sheet, the nozzle sheet is stuck to the protective sheet due to the adhesion thereof and is raised in the longitudinal direction. This may damage the surface of the nozzle sheet from which ink is ejected (ejection surface). When the protective sheet has high adhesion, the ejection surface of the nozzle sheet may be broken. Moreover, the protective sheet is still adhesive even after being peeled off. Therefore, when the peeled protective sheet comes into contact with a finger or clothing of a user, ink on the protective sheet adheres to the finger or clothing. On the other hand, if the protective sheet has low adhesion, ink will leak. Therefore, the adhesion of the protective sheet cannot be reduced.

The techniques disclosed in Japanese Unexamined Patent Application Publication Nos. Hei 8-187870 and Hei 8-258276 are effective when the ejection surface of the nozzle sheet is flat. However, when the nozzle sheet has an irregular ejection surface, the hermeticity between the protective seal and the ejection surface is reduced since the protective seal is pressed by a sponge. This causes ink to leak. Once ink leaks due to vibration or the like, the sponge absorbs ink by its capillary action to contaminate the entire protective seal with ink. After the contamination, the protective cap cannot be used again.

The techniques disclosed in Japanese Unexamined Patent Application Publication Nos. 2003-170606 and Hei 8-258276 suffer from a problem when a line head larger than A4 size paper with a wide nozzle sheet is used. More specifically, due to the nozzle sheet being thin, when the size of a nozzle sheet is relatively small, the influence of the adhesion of the protective sheet is negligible. However, when the nozzle sheet has a large area, i.e., larger than A4 size paper, the nozzle sheet is affected by the adhesion of the protective sheet. Moreover, when the nozzle sheet has a large area, it is difficult to uniformly press the protective seal against the entire ejection surface by the sponge. On the other hand, if the stressing force of the sponge is increased, the protective seal might unintentionally adhere to the entire ejection surface.

SUMMARY OF THE INVENTION

It is an object of the present invention to provide a liquid ejection head including a reusable nozzle cap and a head cap unit that prevents ink from leaking during transport and storage. When the liquid ejection head is in use, the nozzle cap can be readily detached from the liquid ejection head without damaging the ejection surface of a nozzle sheet. The liquid ejection head can also be used with a large nozzle sheet.

According to a first aspect of the present invention, a nozzle cap for a liquid ejection head includes a nozzle sheet having nozzles, the liquid ejection head ejecting liquid in a reservoir through the nozzles. The nozzle cap includes stoppers disposed below an ejection surface of the nozzle sheet from which the liquid is ejected, the stoppers covering the nozzles so as to prevent the liquid from leaking, the stoppers being composed of a resilient material that does not adhere to the nozzle sheet and that inhibits the liquid from passing therethrough.

In the nozzle cap according to the first aspect of the present invention, the stoppers cover the nozzles to prevent liquid from leaking. The stoppers are composed of the material that does not adhere to the nozzle sheet. Therefore, when the nozzle cap is detached from the liquid ejection head, the ejection surface of the thin nozzle sheet having a large area is not damaged. Moreover, the stoppers are composed of the resilient material that inhibits liquid to pass therethrough. Accordingly, the reusable stopper alone can prevent leakage of liquid.

According to a second aspect of the present invention, a head cap unit includes a casing for covering the entire ejection surface of the nozzle sheet from which the liquid is ejected and a nozzle cap disposed in the casing.

According to a third aspect of the present invention, a liquid ejection head includes the aforementioned head cap unit. The head cap unit is detachable and movable relative to the nozzle sheet to open and close the ejection surface of the nozzle sheet. The nozzle cap covers the nozzles when the ejection surface of the nozzle sheet is closed by the head cap unit.

According to the nozzle cap for the liquid ejection head of the third embodiment, the resilient stoppers does not adhere to the nozzle sheet and thus the stoppers are softly pressed against the nozzle. Accordingly, even though the nozzle sheet has low strength at the portions where the nozzles are provided, the nozzle sheet is not damaged when the nozzle cap is in use or when the nozzle cap is detached from the liquid ejection head. Furthermore, since the resilient stoppers inhibit liquid from passing therethrough and tightly adhere to the nozzles, liquid is prevented from leaking during transport. Moreover, the reusable nozzle cap can be used when the liquid ejection head is stored.

DESCRIPTION OF THE PREFERRED EMBODIMENTS

Figure 1:
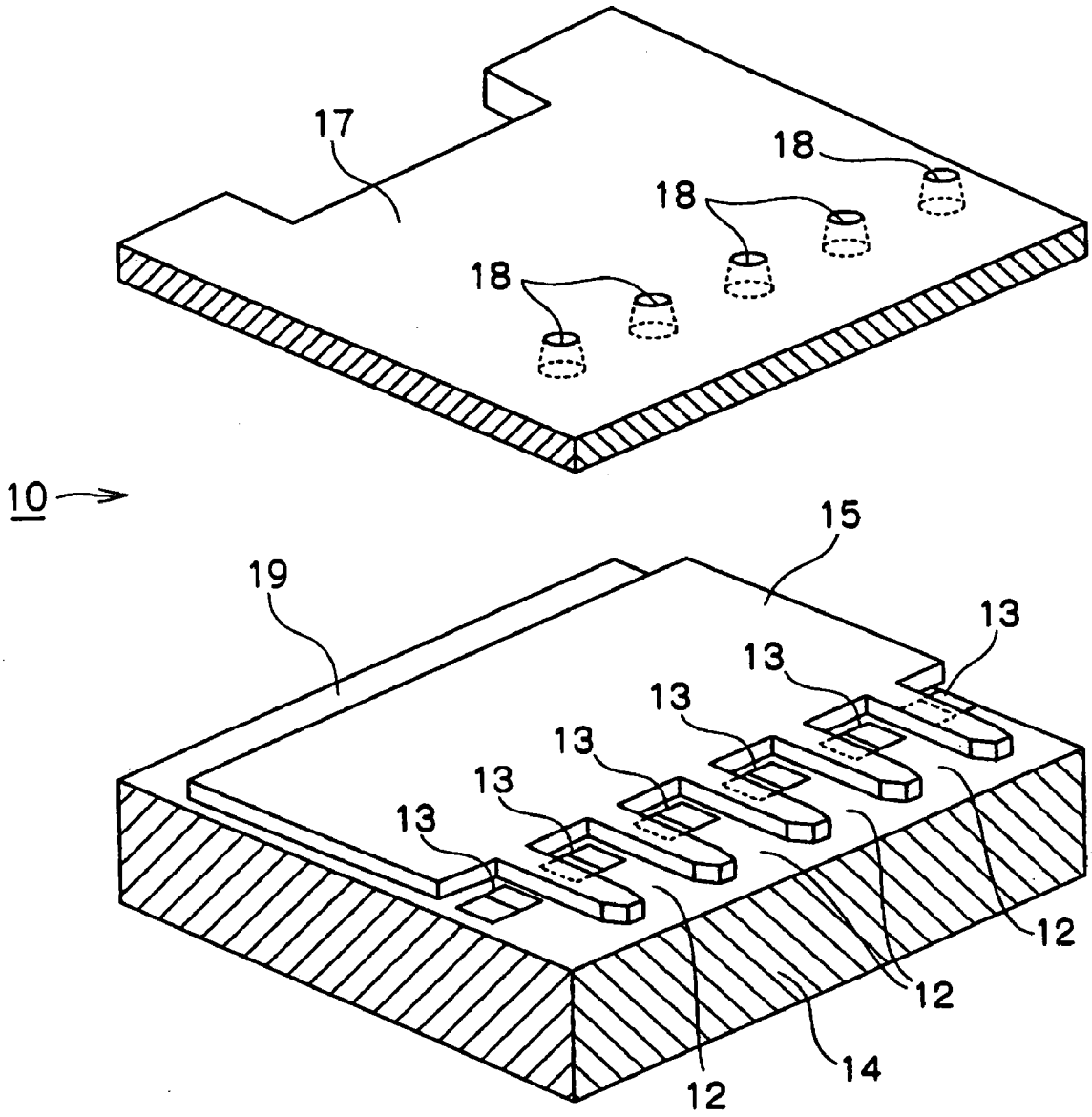
FIG. 1 is a fragmentary perspective view of an enlarged line head according to an embodiment of a liquid ejection head of the present invention.

Embodiments of the present invention will now be described by referring to the accompanying drawings. A liquid ejection head or line head 10 for an inkjet printer according to the present invention includes a plurality of head chips 19 aligned in the widthwise direction of a recording medium, that is, the direction along which nozzles 18 are aligned. The line head 10 is disposed on a nozzle sheet 17.

An ink reservoir 12 contains ink to be ejected in a liquid form. A very small amount, e.g., several picoliters of ink, is ejected from the nozzle 18 as an ink drop. A heating resistor 13 serving as an energy-generating element constitutes the bottom surface of the ink reservoir 12. A reservoir-defining section or barrier layer 15 constitutes a side surface of the ink reservoir 12.

FIG. 1 is a fragmentary perspective view of the enlarged line head 10. For convenience, in FIG. 1, the nozzle sheet 17 and the head chips 19 are separated, and the nozzles 18 and the ink reservoir 12 are inverted in order to clarify their positional relationship. A plurality of the heating resistors 13 is disposed in one direction at a predetermined distance on a substrate 14 of the head chip 19. The barrier layer 15 is disposed on the substrate 14. The nozzles 18 are disposed on the nozzle sheet 17 so as to correspond to the heating resistors 13.

The substrate 14 of the head chip 19 is composed of a semiconductor such as silicon, glass, or ceramic. The heating resistors 13 are provided on a first surface of the substrate 14 by microdeposition technology for semiconductors or electronic devices. The heating resistors 13 are electrically connected to an external circuit via a conductor (not shown) disposed on the substrate 14.

The barrier layer 15 is disposed on the first surface of the substrate 14 on which the heating resistors 13 are disposed. More specifically, first, a photoresist is applied on the entire first surface of the substrate 14 and is exposed by an exposing apparatus through a photo mask with a predetermined pattern, the exposing apparatus emitting light with a waveband suitable for exposure of the photoresist. Then, the exposed photoresist is developed in a predetermined bath and portions that are not exposed to light are removed. In this way, the barrier layer 15 is patterned on the first surface of the substrate 14 excluding the portions in the vicinity of the heating resistors 13.

The nozzle sheet 17 is formed with nickel by electroforming, for example. The nozzle sheet 17 is precisely positioned such that the nozzles 18 face the respective heating resistors 13 and is bonded to the barrier layer 15.

Ink reservoirs 12 are defined by the substrate 14, the barrier layer 15, and the nozzle sheet 17, and the heating resistor 13 is disposed within each ink reservoir 12. That is, the substrate 14 and the heating resistor 13 constitute the bottom surface of the ink reservoir 12, the barrier layer 15 constitutes the side surface of the ink reservoir 12, and the nozzle sheet 17 constitutes the upper surface of the ink reservoir 12, as shown in FIG. 1. The ink reservoir 12 has an opening on the right side thereof in the drawing and ink is supplied from this opening.

When the ink reservoir 12 is filled with ink, a pulsating electric current is applied to the heating resistor 13 for a short period of time, e.g., 1 μsec to 3 μsec, in response to a command from a controlling section. This causes the heating resistor 13 to rapidly heat up. This heat, in turn, vaporizes ink to create an ink bubble at a portion in contact with the heating resistor 13. As the ink bubble expands by boiling of the ink, a predetermined volume of ink is expelled. Accordingly, an ink drop having the same volume as that of the ink expelled is ejected from the nozzle 18 onto a print sheet serving as a recording medium.

Ink may leak from the nozzles 18 due to vibration during transport of the line head 10, for example. Thus, a nozzle cap 30 is necessary to cover the nozzles 18.

Figure 2:
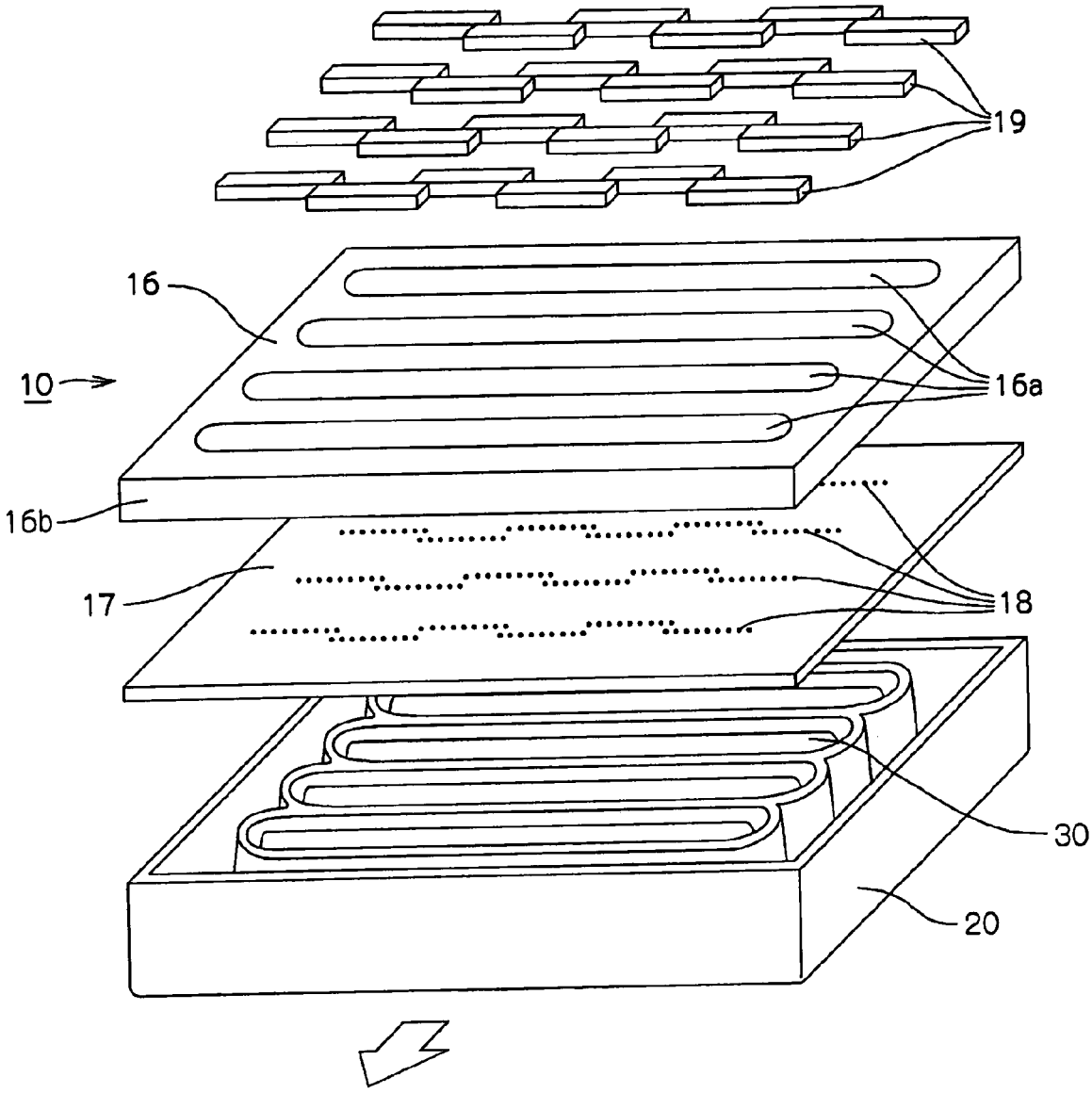
FIG. 2 is an exploded perspective view of the line head for color printing according to the embodiment.

Next, the line head 10, a head cap unit 20 in the line head 10, and the nozzle cap 30 in the head cap unit 20 will be described hereinbelow. FIG. 2 is an exploded perspective view of the line head 10 for color printing for A4 size sheets. Referring to FIG. 2, the head chips 19 in a line are staggered and four lines of the staggered head chips 19 are arranged in parallel. The single nozzle sheet 17, which includes the nozzles 18 corresponding to the ink reservoirs 12 in the head chips 19, is disposed below the head chips 19 and is bonded thereto. All of the nozzles 18 including those positioned at the staggered portions are equally spaced.

The four lines of the head chips 19 are disposed in respective spaces 16*a* in a supporting section or frame 16. Channel plates (not shown) are disposed below the head chips 19 in the spaces 16*a* of the frame 16. Yellow ink (Y), magenta (M) ink, cyan (C) ink, and black (K) ink contained in individual cartridges are supplied to the respective lines of the head chips 19 through the respective channel plates.

The frame 16 is bonded to the nozzle sheet 17 so as to support the nozzle sheet 17 and thus provides rigidity to the wide nozzle sheet 17. The frame 16 has a thickness of about 5 mm and an area corresponding to that of the nozzle sheet 17. The length of the space 16*a* for each line of the head chips 19 is about 21 cm, which corresponds to the width of an A4 size sheet.

The head cap unit 20 for opening and closing the lower surface of the nozzle sheet 17, that is, the surface from which ink is ejected (ejection surface) is disposed below the nozzle sheet 17 (the side from which ink is ejected). This detachable head cap unit 20 can be shifted with respect to the nozzle sheet 17 in the direction designated by the arrow in FIG. 2.

The nozzle cap 30 is disposed in the head cap unit 20. Since the head cap unit 20 closes the ejection surface of the nozzle sheet 17 so as to cover the nozzles 18, ink does not leak from the ink reservoirs 12.

Figure 3:
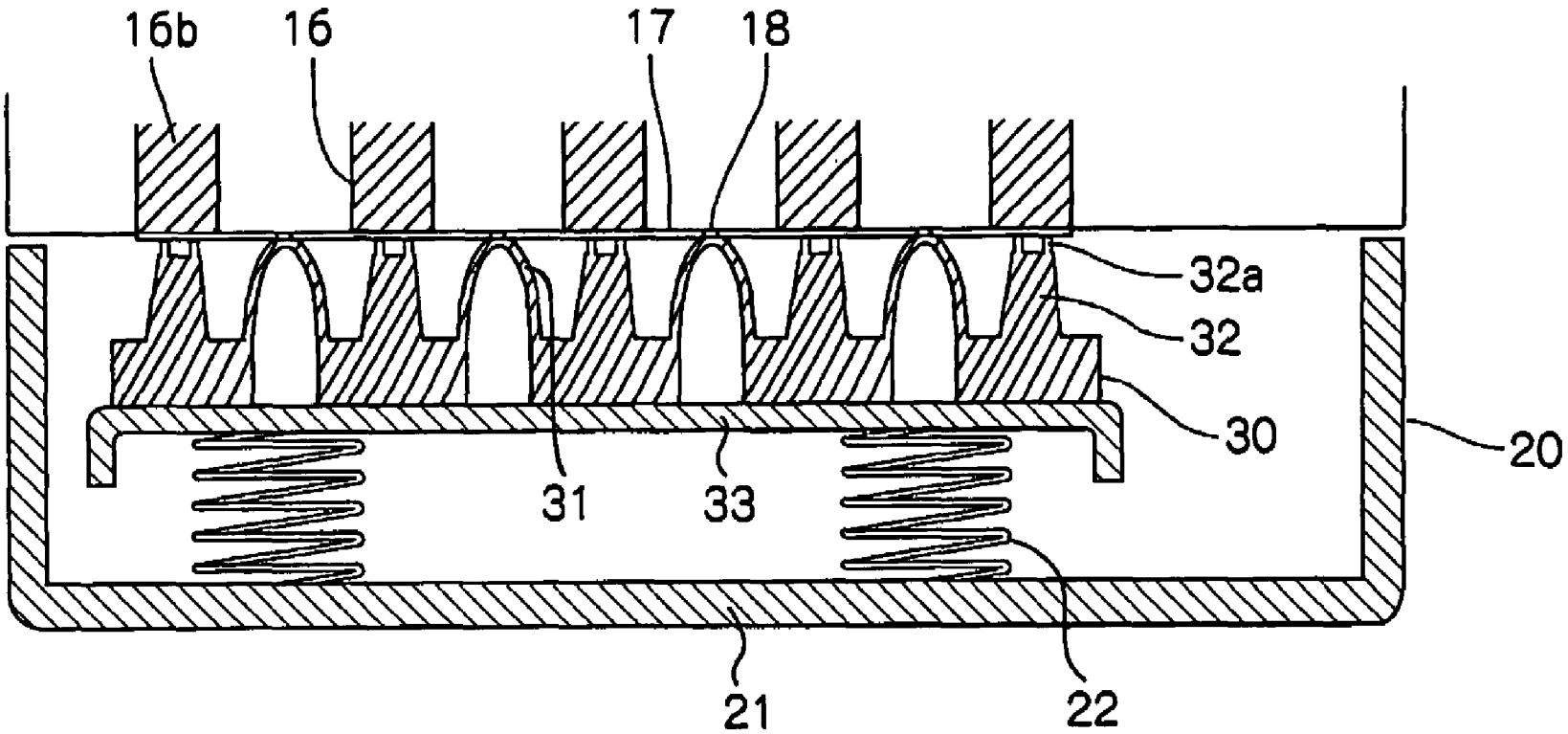
FIG. 3 is a cross-sectional view of a head cap unit according to the embodiment.
Figure 4:
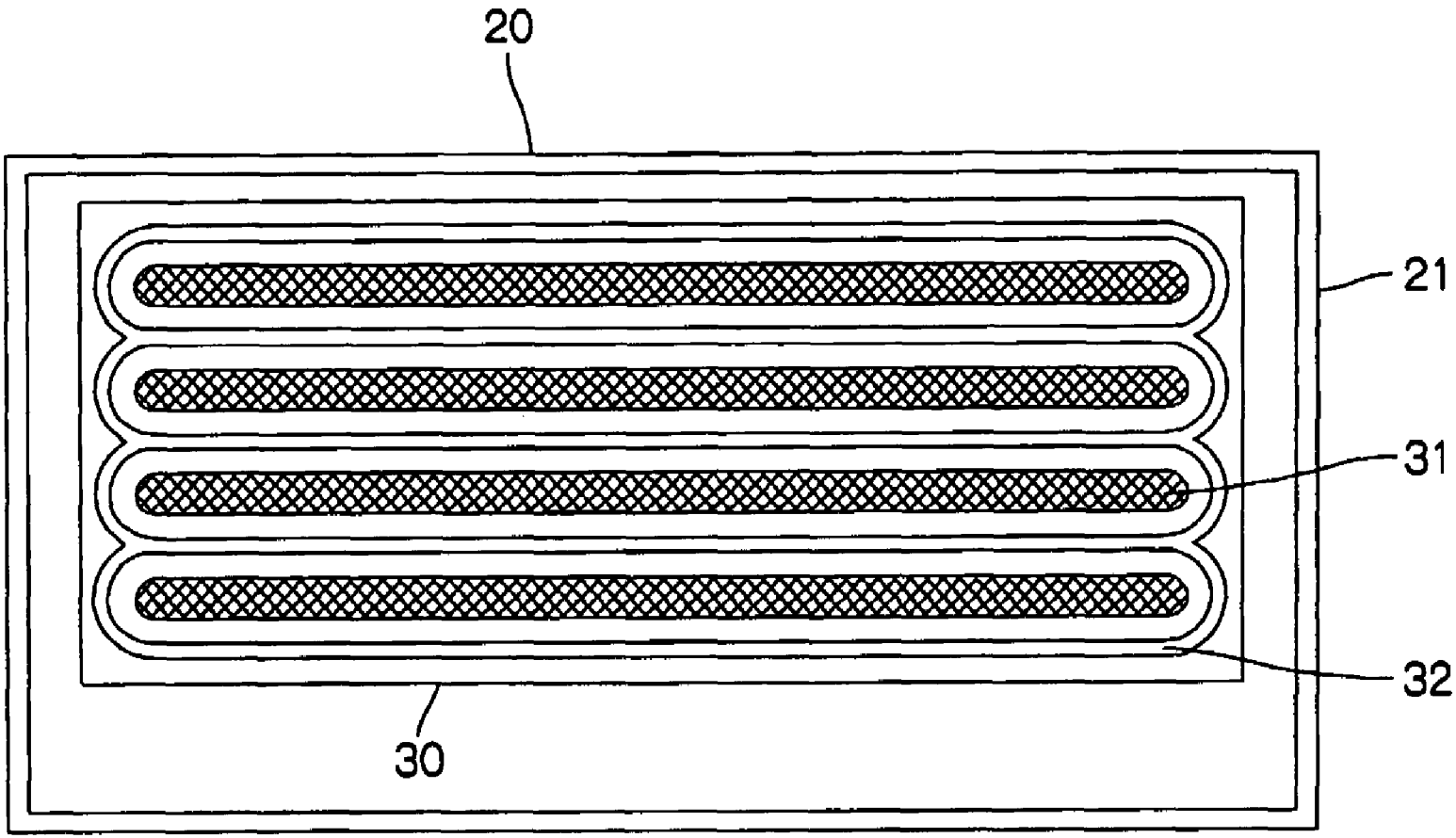
FIG. 4 is a top view of the head cap unit shown in FIG. 3.

FIG. 3 is a cross-sectional view of the head cap unit 20. FIG. 4 is a top view of the head cap unit 20. Referring to FIGS. 3 and 4, the head cap unit 20 is provided with a casing 21 for covering the entire ejection surface of the nozzle sheet 17. The nozzle cap 30 is disposed in the casing 21 with resilient members 22 interposed therebetween. The resilient members 22 are each composed of a coil spring, as shown in FIG. 3. Alternatively, the resilient members 22 may be composed of various resilient materials such as a flat spring, rubber, or sponge.

Referring to FIG. 3, four stoppers 31 having round tips protrude from a base 33 in the nozzle cap 30 and are composed of a resilient material. The interiors of the hollow stoppers 31 are filled with air and thus have flexible resilience. The four stoppers 31 extend in the longitudinal direction in FIG. 4 and are arranged at a predetermined distance therebetween to correspond to the four lines of the nozzles 18.

The nozzle cap 30 includes five sidewalls 32 enclosing the stoppers 31. As shown in FIG. 3, two ribs 32*a* are provided at the tip of each side-wall 32. The stoppers 31 and the sidewalls 32 including the ribs 32*a* are integrally formed of a resilient material having no adhesion to the nozzle sheet 17 and no permeability to ink. Examples of this resilient material include an elastic body composed of rubber (elastomer) with high resilience and cohesion. The stoppers 31 and the sidewalls 32 are disposed on the base 33. In the aforementioned description, "with no adhesion to the nozzle sheet 17" denotes a property in which the material does not adhere to the nozzle sheet 17 made of nickel by electroforming, that is, the material does not have an affinity for nickel. Alternatively, the nozzle sheet 17 may be treated with a process such that the nozzle sheet 17 does not exhibit an affinity for the material composing the stoppers 31 and the sidewalls 32. On the other hand, "with no permeability to ink" denotes a property in which the material inhibits ink from passing therethrough or does not absorb ink, that is, the material is not porous. Examples of this material include ethylene polypropylene diene monomer (EPDM), butyl rubber, silicone rubber, fluorinated rubber, chlorinated rubber, or rubber coated with fluorine so as not to absorb ink. The five sidewalls 32 correspond to a frame portion 16*b* where no space 16*a* is provided in the frame 16.

The resilient members 22 urge the nozzle cap 30 against the nozzle sheet 17 in the head cap unit 20 shown in FIGS. 3 and 4. The stoppers 31 and the ribs 32*a* of the sidewalls 32 in the nozzle cap 30 are pressed against the ejection surface of the nozzle sheet 17. At this time, all the nozzles 18 are covered by the tips of the stoppers 31, which are composed of the material that inhibits ink from passing therethrough, as described above. Accordingly, even if the line head 10 is vibrated during transport, for example, ink does not leak.

Even though the nozzles 18 are closed by the stoppers 31, occasionally, ink might leak for some reason. However, the stoppers 31 are enclosed by the sidewalls 32, which are composed of the material that inhibits ink from passing therethrough, and the sidewalls 32 are pressed against the ejection surface of the nozzle sheet 17 to provide airtight spaces between the stoppers 31 and the sidewalls 32. Accordingly, at least the ribs 32*a* prevent leakage of ink from spreading. The pressing force of the sidewalls 32 depends on the urging force of the resilient members 22 disposed between the casing 21 and the base 33.

Since the nozzle sheet 17 having a thickness of about 12 μm is formed by electroforming, the portions of the nozzle sheet 17 provided with the nozzles 18 have low strength. Therefore, when the stoppers 31 and the sidewalls 32 are pressed against the nozzle sheet 17, the nozzle sheet 17 might deform or break. However, being hollow elastic bodies with excellent flexibility, the stoppers 31 are softly pressed against the nozzle sheet 17. Therefore, closing the nozzles 18 with the stoppers 31 does not damage the nozzle sheet 17. The urging force of the stoppers 31 depends on the resilient force of the hollows in the stoppers 31 that are filled with air.

The portions of the nozzle sheet 17 against which the ribs 32*a* of the sidewalls 32 are pressed are supported by the frame portion 16*b* of the frame 16. Accordingly, even though the solid sidewalls 32 are pressed against the nozzle sheet 17, these portions of the nozzle sheet 17 have sufficient strength due to the support of the frame portion 16*b*, thereby preventing deformation or breakage of the nozzle sheet 17.

When the ejection surface of the nozzle sheet 17 is closed by the head cap unit 20, the nozzle cap 30 prevents ink from leaking through the nozzles 18. Furthermore, the ejection surface of the nozzle sheet 17 is hermetically sealed and thus ink is prevented from drying, thereby reducing the amount of ink for a preliminary ejection, which is performed when the halted line head 10 is actuated.

When the nozzles 18 eject ink drops onto a print sheet, the head cap unit 20 is shifted or taken out to free the ejection surface of the nozzle sheet 17. This causes the stoppers 31 and the sidewalls 32 in the nozzle cap 30 to become detached from the nozzle sheet 17.

The material composing the stoppers 31 and the sidewalls 32 including the ribs 32*a* does not adhere to the nozzle sheet 17. Thus, shift or detachment of the head cap unit 20 does not cause the ejection surface of the nozzle sheet 17 to become damaged. The nozzle cap 30 can be repeatedly used a number of times, and so the nozzle cap 30 can be used not only during transport but also for temporary storage of the line head 10.

FIGS. 5A to 5E are fragmentary cross-sectional views of various modifications of the nozzle cap 30. According to modifications shown in FIGS. 5A to 5C, the stoppers 31 shown in FIG. 3 are changed. More specifically, each stopper 31 in the nozzle cap 30 shown in FIG. 3 has a round tip and the tip of the stopper 31 slightly penetrates the nozzle 18 so as to close the nozzle 18. On the other hand, a stopper 31 shown in FIG. 5A has a flat tip so that the tip does not penetrates the nozzle 18 but comes into contact with the nozzle 18 so as to close the nozzle 18 with the flat tip. This stopper 31 shown in FIG. 5A can provide a large contact area with the nozzle sheet 17 and thus requires a lower pressing force against the nozzle sheet 17.

Figure 5A:
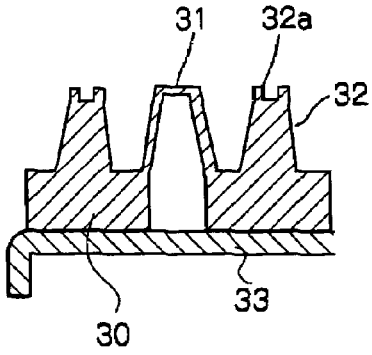
FIGS. 5A to 5E are fragmentary cross-sectional views of various modifications of a nozzle cap according to the present invention.
Figure 5B:
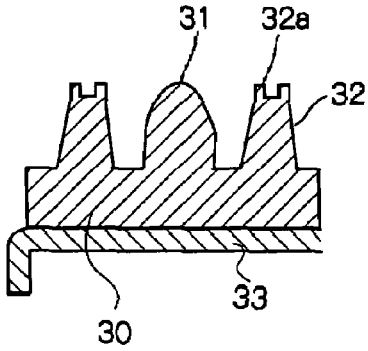
Figure 5C:
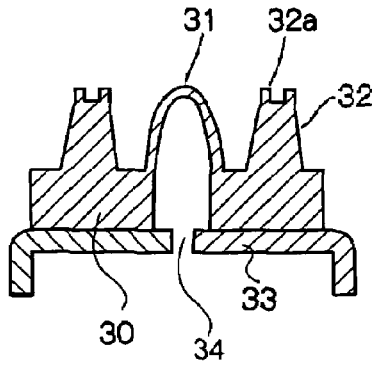

Although nozzle caps 30 shown in FIGS. 5B and 5C have the same shape as the nozzle cap 30 shown in FIG. 3, the interiors of stoppers 31 in the nozzle caps 30 differ. According to the stopper 31 shown in FIG. 5B, the interior of the stopper 31 is not hollow but solid so that the structure of the nozzle cap 30 can be simplified. On the other hand, a hollow stopper 31 shown in FIG. 5C has an air hole 34 at the base 33 to provide an orifice to the stopper 31 functioning as an air spring. Thus, the stopper 31, which is flexible, can attenuate vibration of the base 33.

Figure 5D:
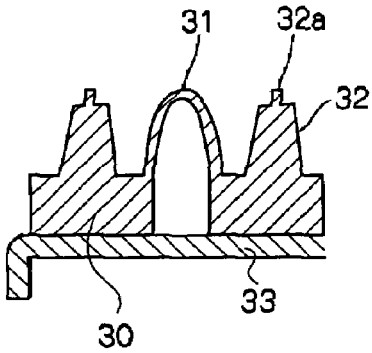
Figure 5E:
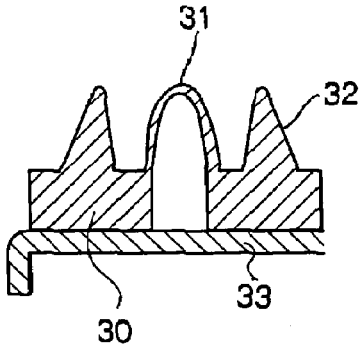

According to modifications shown in FIGS. 5D to 5E, the sidewalls 32 in the nozzle cap 30 shown in FIG. 3 are changed. A side-wall 32 shown in FIG. 5D has a single rib 32*a* at the tip thereof and thus has a simplified structure. According to a side-wall 32 shown in FIG. 5E, the tip of the side-wall 32 is pointed and thus has a simple structure. Although the sidewalls 32 shown in FIGS. 5D and 5E exhibit the same effects as those of the sidewalls 32 shown in FIG. 3, it is preferable to provide two ribs 32*a* in consideration of hermetic sealing.

Figure 6:
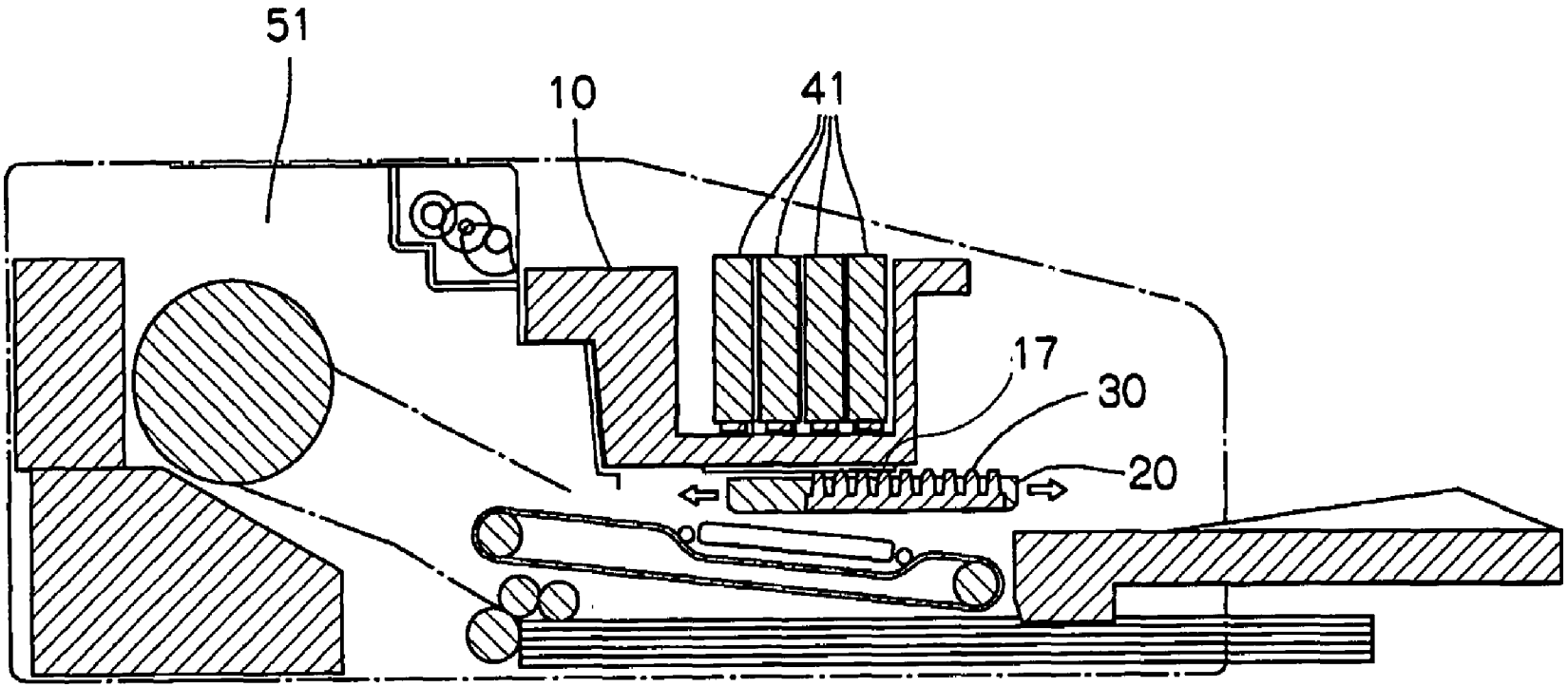
FIG. 6 is a cross-sectional view of an inkjet printer incorporating the line head of the embodiment.

FIG. 6 is a cross-sectional view of an inkjet printer incorporating the line head 10. In the inkjet printer shown in FIG. 6, the separate line head 10 is directly attached to and fixed in a printer body 51.

The line head 10 is fixed at a predetermined position in the printer body 51 and so the printer body 51 functions as an inkjet printer. The printer body 51 includes a feed tray for holding print sheets, that is, recording media, an eject tray, a feeding device, a control circuit, and a head-removable mechanism for attaching and detaching the line head 10 to/from the printer body 51. The line head 10 is attached to the printer body 51 and ink is ejected in accordance with information regarding printing, thereby printing characters or images onto a print sheet.

The head-removable mechanism allows the line head 10 to be mounted at a predetermined position in the printer body 51 and to be fixed with a bar. By releasing the bar fixing the line head 10 in the printer body 51, the line head 10 can be detached from the printer body 51. When mounting the line head 10, the bar is in the upright position and the line head 10 is inserted into a recess disposed in the center area of the printer body 51. Then, the bar is shifted so as to fix the line head 10. The line head 10 is detached from the printer body 51 in reverse order.

The line head 10 includes four ink cartridges 41 each of which is filled with yellow (Y) ink, magenta (M) ink, cyan (C) ink, and black (K) ink. Y, M, C, and K inks are supplied from the bottom surfaces of the respective ink cartridges 41 via the channel plates to the lines of the head chips 19 shown in FIG. 2. Accordingly, ink is ejected from the bottom surface of the nozzle sheet 17 to print a color image onto a sheet.

The head cap unit 20 is disposed on the bottom surface of the nozzle sheet 17. The head cap unit 20 has a shallow box-shape with the top surface being open and covers the entire surface of the nozzle sheet 17. The nozzle cap 30 is disposed in the head cap unit 20. The head cap unit 20 can be moved in the inkjet printer and also can be detached from the inkjet printer.

More specifically, when printing, the head cap unit 20 is shifted to the right in FIG. 6 so as to open the ejection surface of the nozzle sheet 17. In this case, the head cap unit 20 is shifted to the right such that the left edge of the head cap unit 20 is positioned beyond the right edge of the nozzle sheet 17, thereby opening the entire nozzle sheet 17. In this state, a print sheet is supplied from the feed tray and is precisely advanced below the nozzle sheet 17 during ink ejection. On the other hand, when the inkjet printer is halted, the head cap unit 20 is shifted to the left in FIG. 6 such that the nozzle cap 30 closes the ejection surface of the nozzle sheet 17. Therefore, the nozzle cap 30 prevents leakage and drying of ink and clogging of the nozzles. The nozzle cap 30 also prevents contamination and damages at the ejection surface of the nozzle sheet 17.

A cap-opening mechanism controls the reciprocating motion of the head cap unit 20. The cap-opening mechanism is composed of a rack and a pinion engaged with each other. When the line head 10 is mounted in the printer body 51, the cap-opening mechanism shifts the head cap unit 20 relative to the nozzle sheet 17.

When printing, the head cap unit 20 is shifted such that the nozzle cap 30 is detached from the ejection surface of the nozzle sheet 17 to free the ejection surface. When printing is completed, the head cap unit 20 is shifted such that the nozzle cap 30 is pressed against the ejection surface of the nozzle sheet 17 so as to close the ejection surface, thereby preventing leakage of ink.

The cap-opening mechanism is not limited to that described above and various types of mechanism such as a mechanism employing a rubber roller or a timing belt may be used. When the mechanism using a rubber roller is employed, the rubber roller connected to a motor is brought into contact with the side surface of the head cap unit 20. When the motor turns the rubber roller, the head cap unit can be moved by friction.

A cleaning mechanism for the nozzle sheet 17 is typically provided in the inkjet printer. Examples of the cleaning mechanism include a mechanism in which a cleaning roller composed of, e.g., sponge is attached to the head cap unit. When the head cap unit reciprocates, the cleaning roller turns along the ejection surface of the nozzle sheet 17 in accordance with the reciprocating motion of the head cap unit so as to remove ink adhering to the ejection surface.

The head cap unit 20 in the inkjet printer shown in FIG. 6 can be detached from the inkjet printer. When the inkjet printer is not in use for a long period of time, the head cap unit 20 with the nozzle cap 30 can be provided besides the aforementioned head cap unit with the cleaning roller. Provision of the head cap unit 20 prevents ink from drying when the inkjet printer is not in use. Thus, when the inkjet printer is used next time, the amount of ink for a preliminary ejection is minimized.

Alternatively, the cleaning roller may be provided inside the head cap unit 20 along with the nozzle cap 30. In this case, the single head cap unit 20 not only prevents leakage and drying of ink but also allows the cleaning roller to clean the ejection surface.

The present invention is not limited to the above-described embodiments and may be modified within the scope of the present invention. Exemplary variations of the present invention will now be described. The liquid ejection head of the present invention in the above embodiments employs a line-method in which the line head having a length corresponding to the width of a print sheet is used. However, the liquid ejection head may employ a serial-method in which the liquid ejection head can be moved in the widthwise direction of a recording medium during printing.

Although the liquid ejection head according to the above-described embodiments is the line head for color printing, a line head for monochrome printing can also exhibit the same effects as those of the above-embodiments. Moreover, the line head for color printing is not limited to the four-color consolidated type, as described above, and separate line heads for four colors may also be applicable.

Although in the above embodiments, the stoppers extend in the direction along which the nozzles are aligned in the nozzle cap, a stopper may be provided for each nozzle. Alternately, a stopper may be provided for each group of nozzles (for example, one group of nozzles in the staggered arrangement).

In the above-embodiments, a heating resistor is used as an energy-generating element. Alternatively, instead of the heating element, two electrodes may be disposed below an oscillator with an air layer interposed therebetween and application of a voltage to these electrodes warps the oscillator. Then, static electricity is discharged to make the oscillator return to its original shape. With the use of this resilience of the oscillator, ink drops are ejected. Alternatively, a composite including a piezoelectric element having electrodes on both sides and an oscillator may be used to deform the oscillator by the piezoelectric effect to discharge ink drops.

The nozzle cap, head cap unit, and liquid ejection head according to the above-embodiments are preferably used in an inkjet printer, for example. The recording media is not limited to the print sheet. The present invention may be applied to a liquid ejection head for ejecting dye on a fabric or a liquid ejection head to eject a DNA-containing solution in order to analyze a biological sample.

What is claimed is:

1. A nozzle cap for a liquid ejection head comprising a nozzle sheet including nozzles, the liquid ejection head ejecting liquid in a reservoir through the nozzles, the nozzle cap comprising stoppers disposed at an ejection surface of the nozzle sheet from which the liquid is ejected, the stoppers covering the nozzles so as to prevent the liquid from leaking, the stoppers being comprised of a resilient material that inhibits the liquid from passing therethrough, and further comprising at least one sidewall contacting a surface of the nozzle sheet providing a barrier to trap liquid between at least one stopper and the sidewall.

2. The nozzle cap according to claim 1, wherein each of the stoppers has a tip that covers the corresponding nozzle.

3. The nozzle cap according to claim 1, wherein the stoppers are disposed at a predetermined distance along lines of the nozzles in the nozzle sheet.

4. The nozzle cap according to claim 1, wherein the stoppers are hollow.

5. The nozzle cap according to claim 1, further comprising sidewalls enclosing the stoppers, the sidewalls being pressed against the ejection surface of the nozzle sheet to provide airtight spaces between the stoppers and the sidewalls, the sidewalls being composed of a resilient material that does not adhere to the nozzle sheet and that inhibits the liquid from passing therethrough.

6. A head cap unit for a liquid ejection head comprising a nozzle sheet including nozzles, the liquid ejection head ejecting liquid in a reservoir through the nozzles, the head cap unit comprising:

a casing for covering the entire ejection surface of the nozzle sheet from which the liquid is ejected; and a nozzle cap disposed in the casing, the nozzle cap comprising stoppers disposed at an ejection surface of the nozzle sheet, the stoppers covering the nozzles to prevent the liquid from leaking, the stoppers being composed of a resilient material that inhibits the liquid from passing therethrough, and further comprising at least one sidewall contacting a surface of the nozzle sheet providing a barrier to trap liquid between at least one stopper and the sidewall.

7. The head cap unit according to claim 6, further comprising a resilient member between the casing and the nozzle cap, the resilient member urging the nozzle cap against the ejection surface of the nozzle sheet.

8. A liquid ejection head comprising:

head chips including a plurality of energy-generating elements disposed at a predetermined distance in one direction;

a nozzle sheet including nozzles for ejecting liquid drops;

a reservoir-defining section disposed between the nozzle sheet and the surfaces of the head chips on which the energy-generating elements are disposed, the reservoir-defining section defining reservoirs between the energy-generating elements and the nozzles; and a detachable head cap unit for covering the entire ejection surface of the nozzle sheet from which the liquid is ejected, the head cap unit comprising a nozzle cap therein, the head cap unit being movable relative to the nozzle sheet to open and close the ejection surface of the nozzle sheet, the nozzle cap comprising stoppers for covering the nozzles when the ejection surface of the nozzle sheet is closed by the head cap unit so as to prevent the liquid from leaking, the stoppers being composed of a resilient material that inhibits the liquid from passing therethrough, and further comprising at least one sidewall contacting a surface of the nozzle sheet providing a barrier to trap liquid between at least one stopper and the sidewall.

9. The liquid ejection head according to claim 8, wherein a supporting section is bonded to a surface of the nozzle sheet opposite from the election surface, the supporting section having spaces in which the head chips are disposed, the nozzle cap comprising sidewalls enclosing the stoppers, the sidewalls being pressed against the ejection surface of the nozzle sheet to provide airtight spaces between the stoppers and the sidewalls, the sidewalls being composed of a resilient material that does not adhere to the nozzle sheet and that inhibits the liquid from passing therethrough, the sidewalls being pressed against portions of the nozzle sheet when the head cap unit closes the ejection surface of the nozzle sheet, the portions being supported by the supporting section.

* * * * *